US005522100A

United States Patent [19]

Schilling et al.

[11] Patent Number: 5,522,100

[45] Date of Patent: Jun. 4, 1996

[54] STRETCHER WITH TRANSFER BOARD WHICH RETRACTS BETWEEN LITTER AND FRAME

[75] Inventors: Troy C. Schilling, Portage; Martin W. Stryker, Kalamazoo, both of Mich.

[73] Assignee: Stryker Corporation, Kalamazoo, Mich.

[21] Appl. No.: 238,908

[22] Filed: May 6, 1994

[51] Int. Cl.[6] ..... A61G 1/02

[52] U.S. Cl. ..... 5/86.1; 5/185; 5/430

[58] Field of Search ..... 5/81.1, 86.1, 185, 5/430

[56] References Cited

U.S. PATENT DOCUMENTS

| | | | |
|---|---|---|---|
| 3,293,668 | 12/1966 | Auer | 5/81.1 |
| 3,344,445 | 10/1967 | Crawford . | |
| 3,932,903 | 1/1976 | Adams et al. | 5/430 X |
| 4,002,330 | 1/1977 | Johansson | 5/430 X |
| 4,011,609 | 3/1977 | Bethlen . | |
| 4,012,799 | 3/1977 | Rutherford . | |
| 4,206,525 | 6/1980 | Williams . | |
| 4,747,171 | 5/1988 | Einsele et al. | 5/430 X |
| 4,761,841 | 8/1988 | Larsen . | |
| 4,839,933 | 6/1989 | Plewright et al. . | |
| 4,873,732 | 10/1989 | Perez . | |
| 4,985,946 | 1/1991 | Foster et al. . | |
| 4,987,623 | 1/1991 | Stryker et al. . | |
| 5,187,824 | 2/1993 | Stryker . | |
| 5,197,156 | 3/1993 | Stryker et al. . | |

FOREIGN PATENT DOCUMENTS 2068850 8/1981 United Kingdom .

OTHER PUBLICATIONS

Tomac Surgilift II Stretcher; Excerpt from American Hospital Supply Catalogs (2 pages).

PAL Patient Lift; "Transport Patients More Quickly"; Health Care Systems,p. 6.

Patient–Mover Stretcher; T.B.S., Inc. Marketing Flyer (1 page).

Maquet Stretcher; Excerpt from descriptive document (1 page).

MLA Mobilizer Stretcher; Medical Laboratory Automation, Inc. Marketing Brochure (2 pages).

Easy–Lift Stretcher; Excerpt from Hausted Marketing Brochure (1 page).

*Primary Examiner*—Michael F. Trettel

*Attorney, Agent, or Firm*—Flynn, Thiel, Boutell & Tanis

[57] ABSTRACT

A stretcher includes a patient support portion vertically movably supported on a wheeled base by a lift arrangement. Two pivot members are supported on the support portion for pivotal movement about respective vertical axes, and each support a respective arm for pivotal movement about a respective horizontal axis between a position in which the arms lie in a common horizontal plane and a position in which an outer end of each arm is offset from the plane. The outer end of each arm is movably coupled to a transfer board. A link arrangement effects synchronous movement of the arms about the horizontal axes without movement about the vertical axes and about the vertical axes without movement about the horizontal axes. In a retracted position, the entire transfer mechanism is disposed physically within and has an overall vertical height less than that of the patient support portion.

18 Claims, 11 Drawing Sheets

STRETCHER WITH TRANSFER BOARD WHICH RETRACTS BETWEEN LITTER AND FRAME

FIELD OF THE INVENTION

The present invention relates generally to a bed or stretcher having a transfer mechanism for facilitating patient transfers and, more particularly, to such a transfer mechanism which includes a transfer board movable between operational and retracted positions.

BACKGROUND OF THE INVENTION

During use of a mobile stretcher in a hospital, it is frequently necessary to transfer a patient from the stretcher to another stretcher or to a bed or X-ray table, or vice versa. In some cases, this is done by simply positioning the two stretchers side by side and then having several persons physically lift and slide the patient from one stretcher to the other. This is dangerous to the patient, because the patient may be dropped on the floor between the stretchers. Further, it is dangerous to hospital personnel, because it is a common source of serious back injuries.

Devices have previously been developed to facilitate patient transfers. Early devices were special mechanisms separate from a stretcher, but these could be misplaced or at least might not be readily available when it was necessary to effect a patient transfer. Other devices were motor-driven and required electricity from a wall outlet, but wall outlets are not always handy when a patient transfer must be made.

One rather effective prior approach is to provide a transfer board which is movably supported on the stretcher itself, and in particular moves between a retracted position disposed below the patient support and an operational position bridging the gap between the patient support surfaces between which the patient is to be transferred. Examples of this type of transfer board are disclosed in U.S. Pat. Nos. 4,987,623 and 5,197,156, both of which are assigned to the same Assignee as the present application. While these pre-existing transfer boards have been generally adequate for their intended purposes, they have not been satisfactory in all respects.

The most important disadvantage is that, in the retracted position, they a project a relatively significant distance below the patient litter, and therefore interfere with the extent to which the patient support can be moved downwardly toward the base and the extent to which medical equipment can be temporarily inserted between the patient support and base for diagnostic or other purposes.

Accordingly, an object of the present invention is to provide an improved transfer mechanism which, in the retracted position, has a small and compact vertical height, and preferably can be contained completely within the patient support with no significant increase in size of the patient support.

A further object is to provide such a transfer mechanism which is comparable in structural complexity to or is structurally simpler than existing transfer board mechanisms.

SUMMARY OF THE INVENTION

The objects and purposes of the invention, including those set forth above, are met according to one form of the present invention by providing an apparatus which includes: a wheeled base, a support portion having thereon an upwardly facing support surface, a lift arrangement supporting the support portion on the base for vertical movement relative to the base, a member, and an arrangement supporting the member on the support portion for movement between a retracted position in which the member is disposed substantially entirely below the support surface and an operational position in which the member is offset horizontally and vertically from the retracted position thereof, wherein the arrangement supporting the member includes first and second arms each having a first end movably coupled to the member and having a second end, and includes an arrangement supporting each arm at the second end thereof on the support portion for pivotal movement about a respective substantially vertical pivot axis and for movement between first and second positions about a respective substantially horizontal pivot axis.

According to a different form of the present invention, an apparatus includes: a wheeled base, a support portion having thereon an upwardly facing support surface, a lift arrangement supporting the support portion on the base for vertical movement relative to the base, an arrangement defining a recess which opens sidewardly into the support portion at a location below the support surface thereon, a member, and an arrangement supporting the member for movement between a retracted position in which the member is disposed substantially entirely within the recess and an operational position in which the member is disposed outside the recess and is offset horizontally and vertically from the retracted position thereof, wherein the arrangement includes two arms which each have a first end movably coupled to the member and which each have a second end disposed within the recess, and an arrangement movably supporting the second end of each the arm on the support portion.

According to yet another form of the invention, an apparatus includes: a wheeled base, a support portion having thereon an upwardly facing support surface, a lift arrangement supporting the support portion on the base for vertical movement relative to the base, an arrangement defining a recess which opens sidewardly into the support portion at a location below the support surface thereon, a transfer member having thereon a transfer surface, and an arrangement supporting the transfer member for movement between a retracted position in which the transfer member is disposed substantially entirely within the recess and an operational position in which the transfer member is disposed in the region of an edge portion of the support surface on the support portion and is oriented so that the transfer surface is facing upwardly and is at approximately the same vertical level as the support surface on the support portion, the transfer surface including a portion which is disposed horizontally outwardly beyond the edge portion of the support surface in the operational position of the transfer member.

Still another form of the present invention involves an apparatus which includes: a wheeled base, a support portion having thereon an upwardly facing support surface, a lift arrangement supporting the support portion on the base for vertical movement relative to the base, a member, and an arrangement supporting the member on the support portion for movement between a retracted position in which the member is disposed substantially entirely below the support surface and an operational position in which the member is offset horizontally and vertically from the retracted position thereof, wherein the arrangement movably supporting the member includes an arm having a first end coupled to the member and having a second end, and includes an arrangement supporting the second end of the arm on the support portion for pivotal movement about a substantially vertical pivot axis and for pivotal movement about a substantially horizontal pivot axis.

BRIEF DESCRIPTION OF THE DRAWINGS

A preferred embodiment of the present invention is described in detail hereinafter with reference to the accompanying drawings, in which.

DETAILED DESCRIPTION

Figure 1:
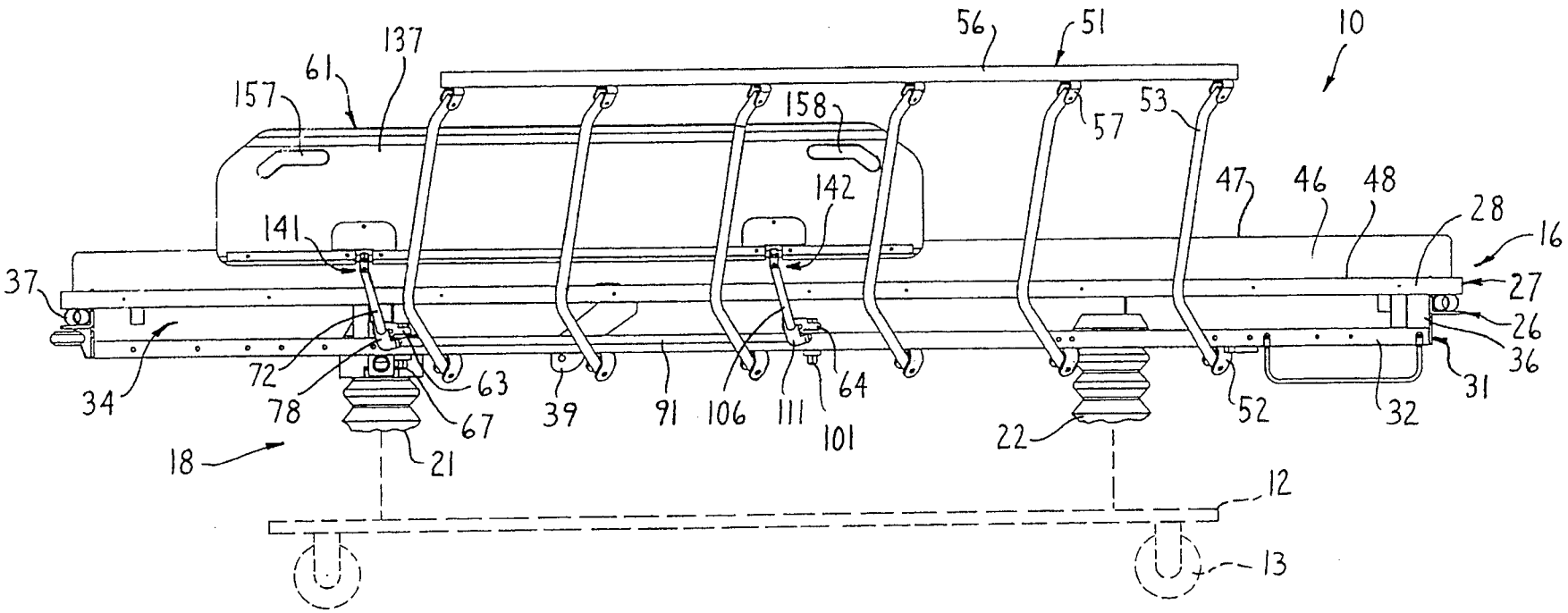
FIG. 1 is an elevational side view of a hospital stretcher embodying the present invention, a portion of which is shown diagrammatically.

Referring to FIG. 1, reference numeral 10 designates a mobile bed or stretcher which embodies the present invention. The stretcher 10 includes a diagrammatically depicted base 12 movably supported by four caster wheels 13, and a patient support 16 vertically movably supported on the base 12 by a lift arrangement 18. The lift arrangement 18 includes a pair of spaced lift columns 21 and 22 which each have a lower end supported on the base 12 and an upper end supporting the patient support 16, the lift columns 21 and 22 being adjustable in vertical height in order to raise and lower the patient support 16 relative to the base 12. The lift columns 21 and 22 are conventional and their internal structure is not a part of the present invention, and they are therefore not described in further detail.

Figure 2:
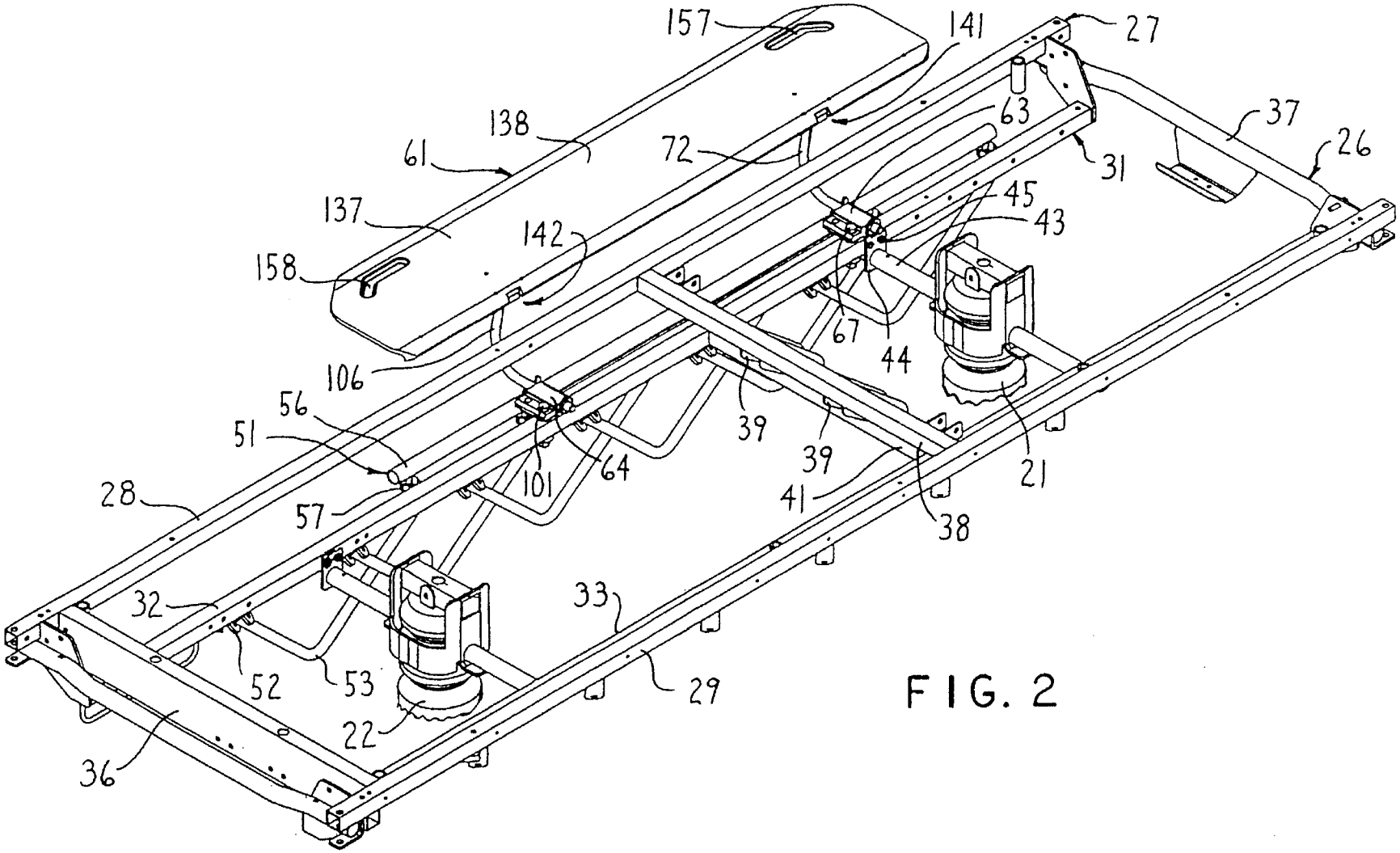
FIG. 2 is a perspective view of selected portions of the stretcher of FIG. 1, including a lift arrangement, a support frame, a transfer board mechanism, and a retractable side rail.

Referring to FIGS. 1 and 2, the patient support 16 has a frame 26 with an upper frame portion 27 which includes a pair of spaced and parallel side members 28 and 29, and a lower frame portion 31 which includes a pair of parallel and spaced side members 32 and 33. The transverse distance between the side members 32 and 33 is less than the transverse distance between side members 28 and 29. The upper frame portion 27 is vertically higher than the lower frame portion 31, so as to define on each side of the frame 26 a lengthwise slot-like opening or recess which opens horizontally into the frame 26 between the side members 28 and 32 or between the side members 29 and 33. In order to rigidly hold the upper frame portion 27 and lower frame portion 31 in this vertically spaced relationship with respect to each other, the frame 26 has transversely extending end sections 36 and 37 at respective ends thereof, which each are fixedly coupled to the ends of each of the side members 28–29 and 32–33.

Referring to FIG. 2, the upper frame portion 27 also has in a central region a cross member 38 which extends transversely between and has its ends fixedly secured to the side members 28 and 29. Two pairs of plates 39 are fixedly welded to the cross member 38 at spaced locations therealong so that all four plates 39 are parallel to each other, the plates 39 each extending downwardly from the cross member 38 at an angle. The lower frame portion 31 has in a central region a cross member 41 which extends transversely between and has its ends fixedly secured to the side members 32 and 33.

Figure 3:
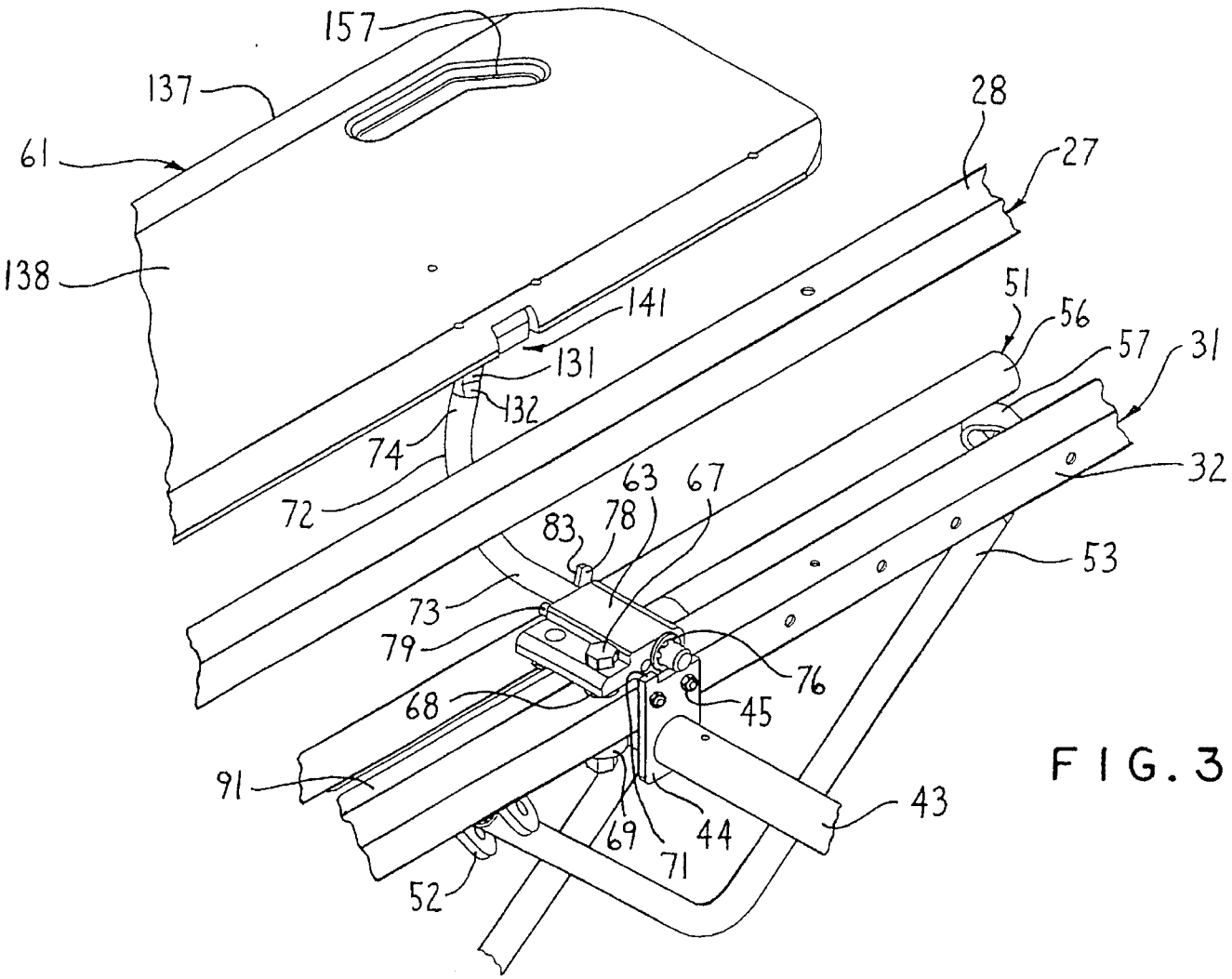
FIG. 3 is a view in an enlarged scale of a portion of the perspective view of FIG. 2.

As best seen in FIG. 2, the lift columns 21 and 22 each have at the upper end thereof a pair of support rods which project horizontally outwardly in opposite directions, one of which is identified with reference numeral 43. Each such rod has secured to its outer end a plate which is fixedly bolted to the inner side of a respective one of the side members 32 and 33, FIGS. 2 and 3 showing one such plate at 44 and showing at 45 the bolts and nuts 45 which secure plate 44 to side member 32.

The frame 26 also includes several horizontal metal plates which have been omitted in most of the drawings for clarity, but which are supported on top of the upper frame portion 27 so as to define an upwardly facing surface 48 (FIG. 1) that supports a conventional removable mattress or pad 46, the mattress having on an upper side thereof an upwardly facing patient support surface 47. Alternatively, a conventional articulatible patient support could be provided on the upper frame portion 27 to support the mattress 46, the articulatible patient support having a pivotally adjustable back section or fowler, and a pivotally adjustable leg section or gatch.

The patient support 16 of the stretcher 10 has on each side of the frame 26 a side rail, one of which is shown at 51 in the figures and the other of which has been omitted from the drawings for clarity. The side rail 51 can be moved between a raised position shown in FIG. 1 and a retracted position shown in FIG. 6. The side rail 51 in the preferred embodiment is a zero clearance side rail substantially identical to that disclosed in U.S. Pat. No. 5,187,824, the disclosure of which is hereby incorporated herein by reference. The side rail 51 is described only briefly for purposes of clarity.

In particular, the side rail includes six brackets 52 fixedly secured to the underside of side member 32 at spaced locations therealong, and six arms 53 which each have a first end supported on a respective bracket 52 for pivotal movement about an axis which is inclined with respect to each of a direction lengthwise of bed 10, a direction transverse to bed 10, and a vertical direction. The side rail 51 also includes a horizontal top rail 56 having six additional brackets 57 fixedly secured to its underside, each bracket 57 being coupled to a second end of a respective arm 53 for pivotal movement about an axis parallel to the axes at brackets 52.

The patient support 16 of the stretcher 10 has on each side of the frame 26 a transfer board mechanism, one of which is shown at 61 in the figures and the other of which has been omitted from the drawings for clarity. The transfer board mechanism 61 facilitates transfer of a patient to or from the stretcher 10 with respect to another stretcher or bed.

Referring to FIG. 2, the transfer board mechanism 61 includes two pivot members 63 and 64 which are each pivotally supported on the side member 32 of the lower frame portion 31. More specifically, referring to FIGS. 3 and 4, the pivot member 63 is supported on side member 32 for pivotal movement about a vertical axis defined by a bolt and nut 67 which extend through aligned vertical openings in the pivot member 63, a metal washer 68, the side member 32, and a further metal washer 69 which is welded to side member 32. The metal washer 68 reduces friction between the pivot member 63 and side member 32 during relative pivotal movement thereof. The normal operational range of pivotal movement of the pivot member 63 is about 100°, between the position shown in FIG. 3 and a position pivoted 100° counterclockwise from the position of FIG. 3. Plate 44 has an upwardly projecting tab 71 (FIG. 3) which serves as a stop, the pivot member 63 engaging the stop 71 in the position of FIG. 3 to thereby prevent pivotal movement of the pivot member 63 beyond the position of FIG. 3. An L-shaped arm 72 has two cylindrical legs 73 and 74, the leg 73 extending horizontally and having itsouter end rotatably received in a horizontal opening through the pivot member 63, the horizontal opening through the pivot member 63 having a diameter slightly greater than the diameter of the outer end of leg 73. The central axis of leg 73 thus defines a horizontal pivot axis for the arm 72. A push-on retainer 76 (FIG. 3) is provided on the outer end of the leg 73, in order to prevent axial movement of the leg 73 out of the pivot member 63. On the opposite side of pivot member 63, a connecting plate 78 (FIG. 4) is fixedly secured to the leg 73 a small axial distance away from the pivot member 63, and a nylon spacer sleeve 81 closely encircles the leg 73 and extends axially from pivot member 63 to connecting plate 78. A pin 79 has one end fixedly secured in a blind hole provided in the pivot member 63 at a location radially offset from the leg 73, and has its other end projecting outwardly from the pivot member 63 parallel to the leg 73.

The connecting plate 78 has two stop surfaces 83 and 84 thereon which can engage the pin 79 in respective pivotal positions of the arm 72, so as to give the arm 72 a range of pivotal movement of about 105°. When the stop surface 83 is engaging pin 79, the leg 74 of the arm 73 extends approximately horizontally so that the entire arm 73 is disposed substantially in a horizontal plane (FIG. 10), whereas when the stop surface 84 is engaging pin 79 (FIG. 4) the leg 74 of arm 72 extends upwardly at an angle of about 75° (161 in FIG. 14) with respect to a horizontal reference.

The connecting plate 78 has an outer end portion 86 which is bent to extend parallel to each of the legs 73 and 74 of the arm 72 at a location radially offset from leg 73. Therefore, when stop surface 83 is engaging pin 79, the outer end portion 86 extends substantially horizontally, whereas when the stop surface 84 is engaging pin 79 (FIG. 4), the outer end portion 86 extends at an angle of about 75° with respect to a horizontal reference.

Figure 4:
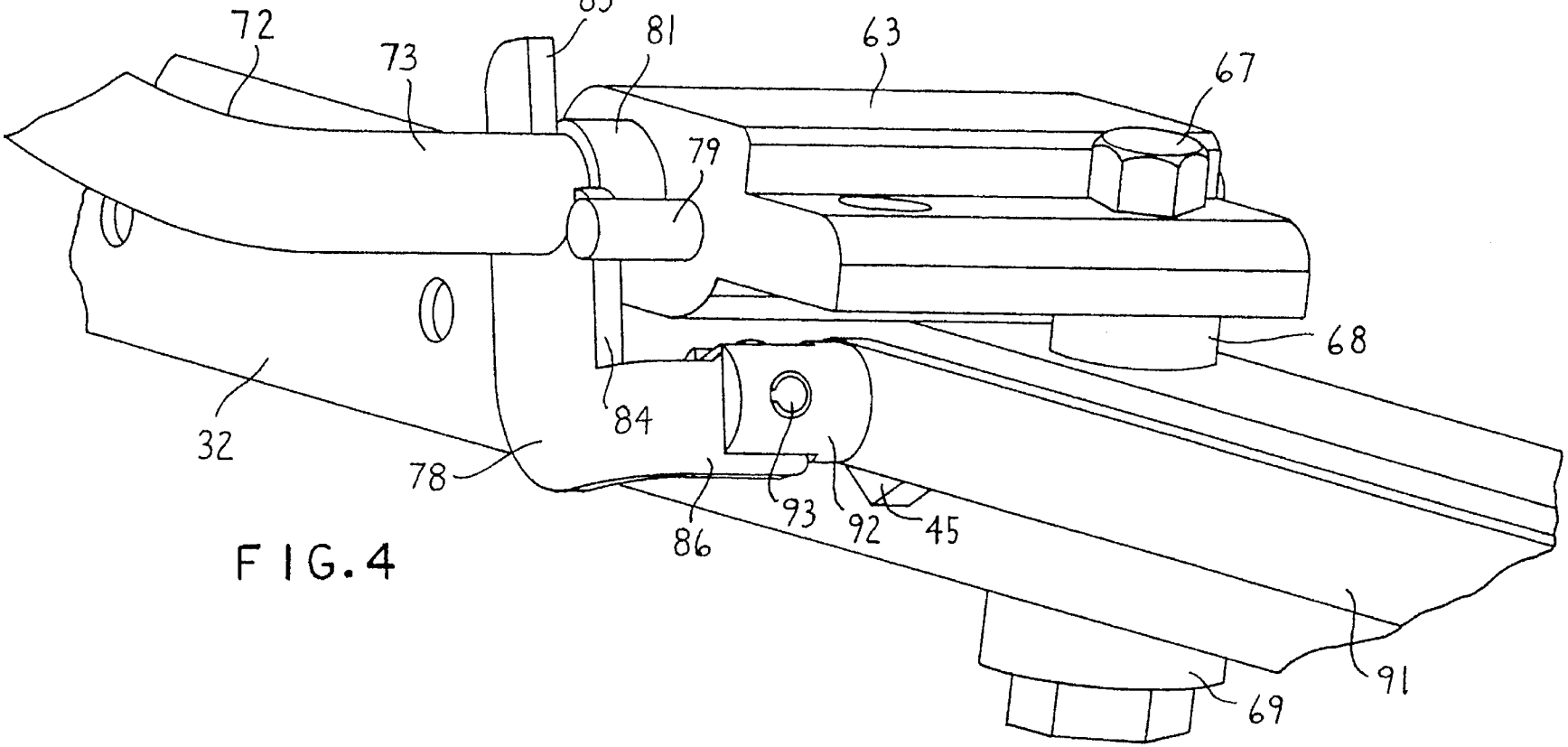
FIG. 4 is a perspective view from a different angle of part of the transfer board mechanism shown in FIG. 3.

In FIG. 4, an elongate link member 91 has a clevis 92 supported on one end thereof for rotational movement about a horizontal axis parallel to the leg 73 of arm 72. In particular, the clevis 92 has a not-illustrated cylindrical axle on the rear side thereof which extends rotatably through a horizontal circular hole in the link member 91 and which has a not-illustrated retainer on its outer end. The outer end portion 86 of the connecting plate 78 is received in the clevis, and a roll pin 93 extends through aligned openings in the clevis 92 and the end portion 86. The roll pin 93 defines a pivot axis perpendicular to the end portion 86. Thus, when the stop surface 83 is engaging pin 79, the roll pin 93 will extend substantially vertically, whereas when the stop surface 84 is engaging pin 79 (FIG. 4), the pin 93 will extend at an angle of about 15° to a horizontal reference.

Figure 5:
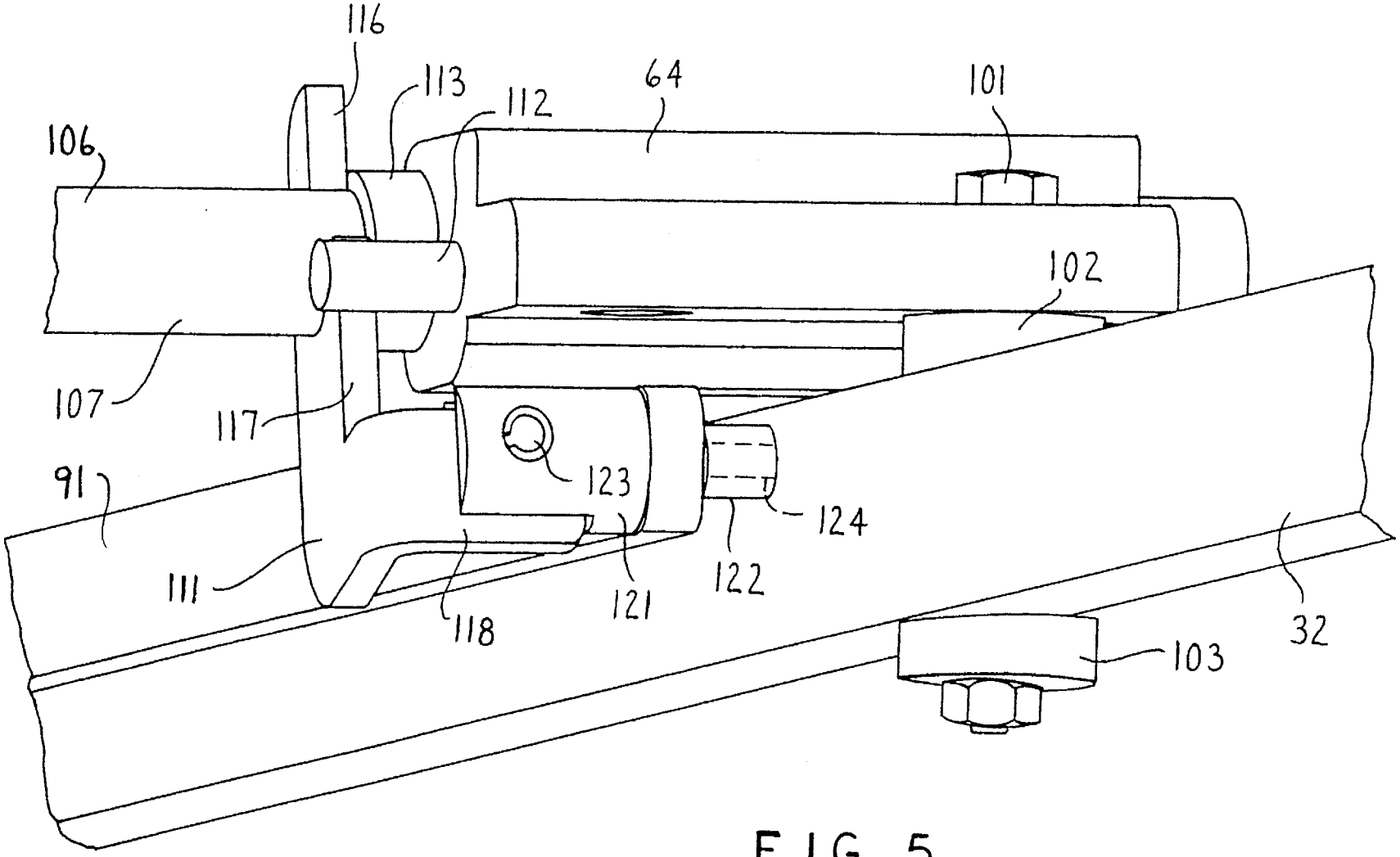
FIG. 5 is a perspective view of another portion of the transfer board mechanism.

Turning now to the pivot member 64, FIG. 5 shows an arrangement similar to that just described in association with FIGS. 3 and 4. In particular, pivot member 64 is supported for pivotal movement about a vertical axis by a vertical bolt and nut 101 and nylon washers 102 and 103, and an L-shaped arm 106 has a horizontal leg 107 rotatably disposed in a horizontal hole through pivot member 64, and has a further leg 108. A spacer sleeve 113 encircles the leg 107 between the pivot member 64 and a connecting plate 111 fixedly secured on the leg 107, the connecting plate 111 having stop surfaces 116 and 117 thereon which are engagable with a pin 112 on the pivot member 64. The stop surfaces 116 and 117 permit the arm 106 to pivot through a 105° range of pivotal movement between positions in which the leg 108 is respectively horizontal and extending upwardly at an angle of 75° to a horizontal reference. An outer end portion 118 of the plate 111 is bent to extend parallel to a plane containing the legs 107 and 108, so that it extends horizontally when stop surface 116 is engaging pin 112 and extends at an angle of 75° to a horizontal reference when stop surface 117 is engaging pin 112 (FIG. 5).

The end of link member 91 remote from clevis 92 supports a further clevis 121 for a rotational movement about a horizontal axis extending parallel to leg 107, the clevis 121 having a cylindrical axle 124 which is parallel to leg 107 and extends rotatably through a circular hole in the link member 91, and having a retainer 122 provided on the outer end of axle 124 in order to retain the clevis 121 on the link member 91. The outer end portion 118 of the plate 111 is received in the clevis 121, and a roll pin 123 extends through aligned openings in the clevis 121 and end portion 118 and serves as a pivot axle. When the stop surface 116 is engaging the pin 112, the roll pin 123 extends vertically, whereas when the stop surface 117 is engaging pin 112 (FIG. 5), the roll pin 123 extends at an angle of about 15° with respect to a horizontal reference.

It will be recognized that the axle 124 could alternatively be threaded and that the retainer 122 could be a nut. Also, the roll pin 123 could alternatively be a bolt and nut.

Figure 6:
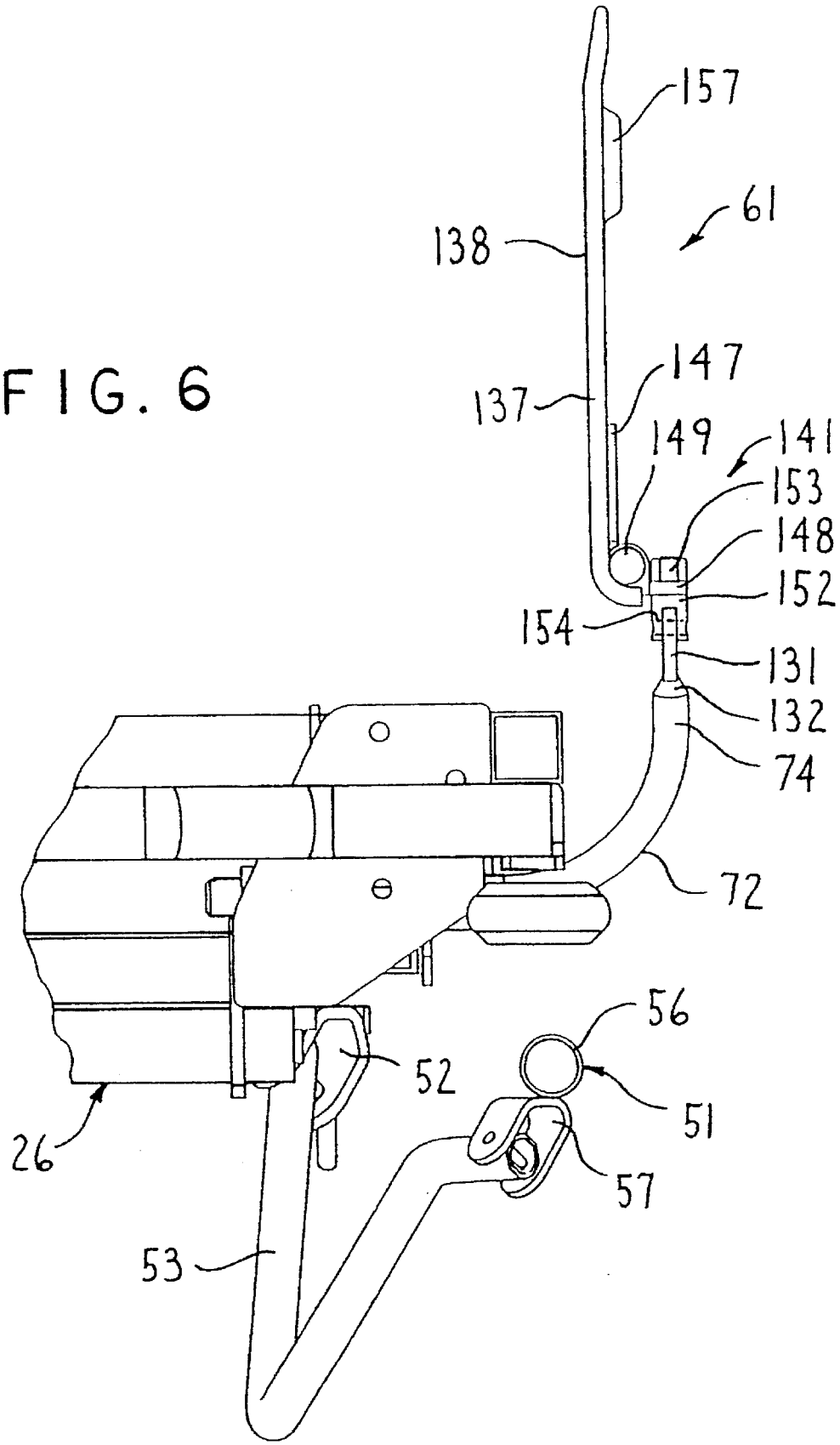
FIG. 6 is an end view of part of the structure of FIG. 2, showing the transfer board mechanism in an operational position with a transfer board oriented upright and showing the side rail in a retracted position.
Figure 12:
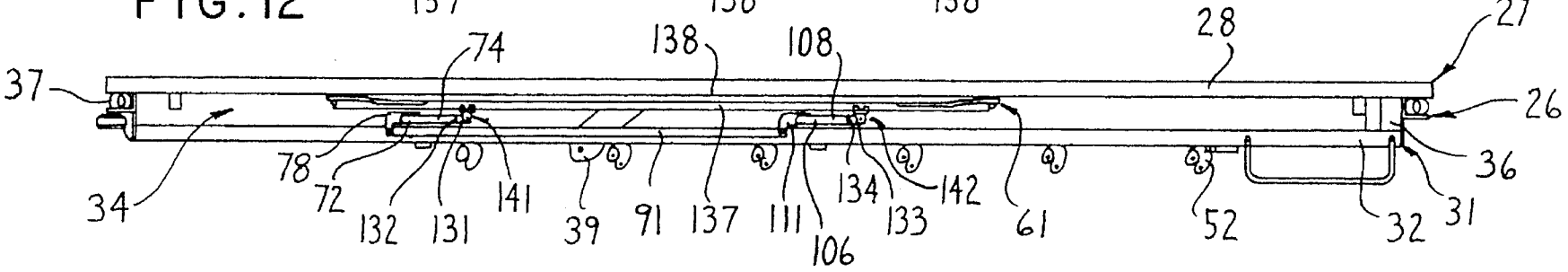

Referring to FIG. 6, the arm 72 includes at its outer end a coupling plate 131 fixedly secured by a weld 32 to the outer end of the leg 74 with an orientation so that coupling plate 131 extends perpendicular to the horizontal pivot axis defined by leg 73. With reference to FIG. 12, a similar coupling plate 133 is fixedly secured by a weld 134 to the outer end of the arm 106. It will be recognized that the plate 131 could alternatively be machined from the material of arm 72.

As shown in FIGS. 1 and 2, the transfer board mechanism 61 also includes a plate-like transfer board 137, which has on one side thereof an approximately planar transfer surface 138 and which is movably coupled by respective universal joints 141 and 142 to the arms 72 and 106. The universal joints 141 and 142 are identical, and therefore only universal joint 141 is described in detail.

More specifically, as shown in FIG. 6, the universal joint 141 includes a hinge having a first hinge leaf 147 which is fixedly secured to the transfer board 137, having a second hinge leaf 148, and having a horizontal pivot pin 149 pivotally coupling the hinge leaf 147 to the hinge leaf 148. The horizontal pivot pin 149 extends in a direction lengthwise of the stretcher 10. A clevis 152 has an upwardly projecting threaded stud which is not visible in the drawings but which extends upwardly and rotatably through a circular hole in the hinge leaf 148 and which has a nut 153 threadedly engaging its upper end, so that the clevis 152 can pivot with respect to the hinge leaf 148 about a vertical axis defined by its threaded stud. The coupling plate 131 on the arm 72 is received within the clevis, and a roll pin 154 extends horizontally through aligned openings in the clevis 152 and coupling plate 131 perpendicular to the plate 131, the roll pin 154 serving as a horizontal pivot axis which is always parallel to the horizontal pivot axis defined by leg 73 of arm 72. Alternatively, a bolt and nut could be used in place of roll pin 154.

AS best seen in FIG. 2, the transfer board 137 has near its end a respective depression 157 or 158, each of which can receive the tips of an operator's fingers in order to permit an operator to reliably manually grip the transfer board 137 in order to move it.

OPERATION

Figure 9:
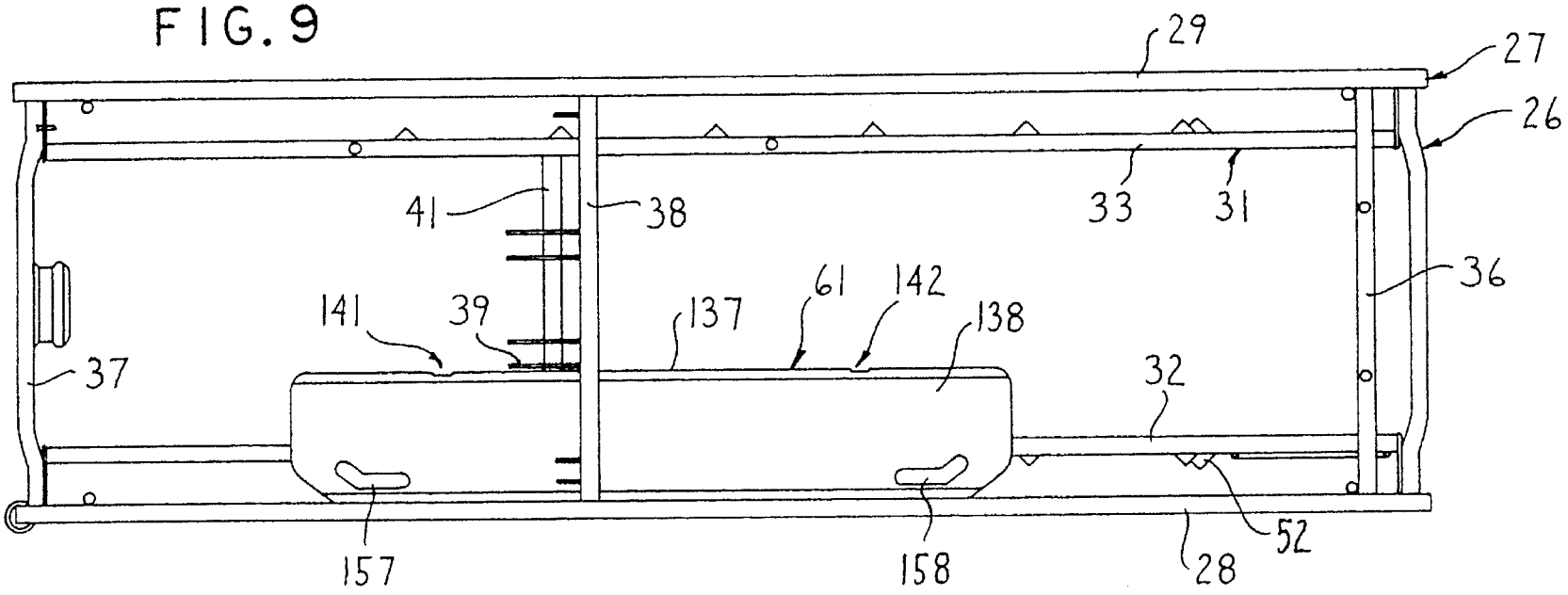
FIGS. 9 and 10 are respectively a top view and side view of the frame and transfer board mechanism of FIG. 2, showing the transfer board mechanism in its retracted position.
Figure 10:
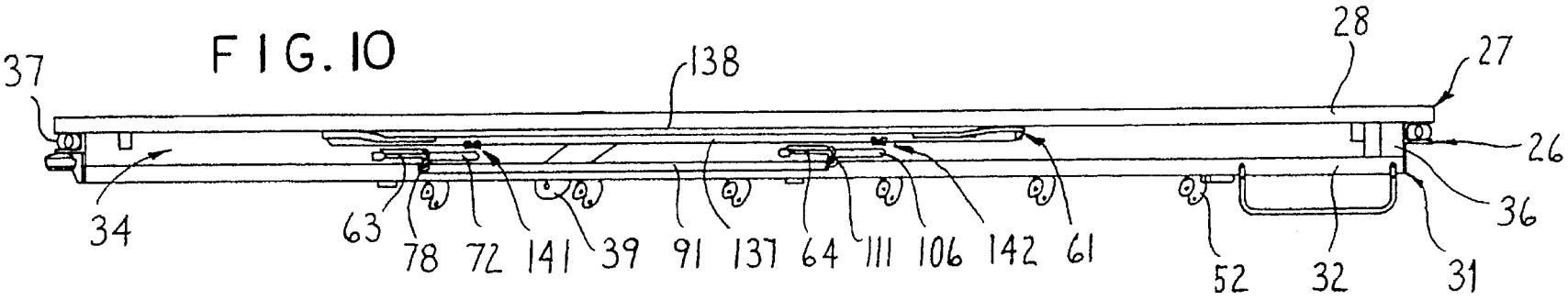
Figure 13:
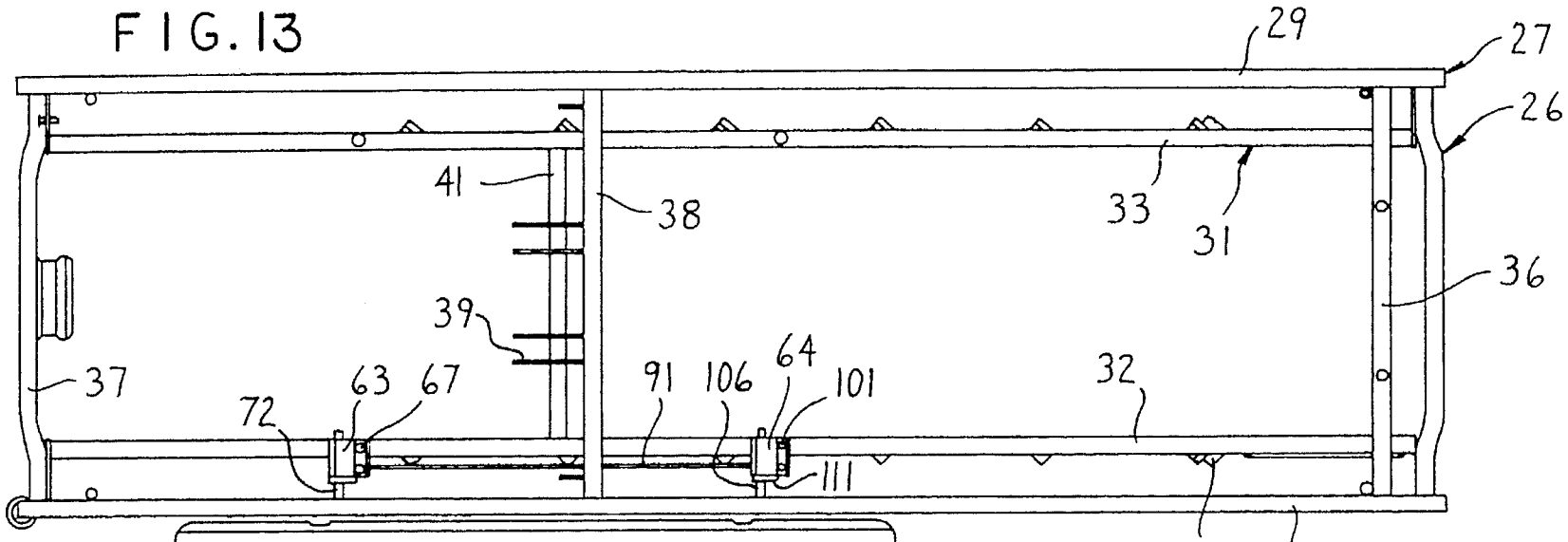
FIGS. 13 and 14 are views similar to FIGS. 9 and 10, but showing the transfer board mechanism in its operational position.

The operation of the transfer board mechanism 61 will now be described. In this regard, the transfer board 137 can be moved between an operational position (FIGS. 7 and 13–14) and a retracted position (FIGS. 9–10). In the operational position, the transfer board is disposed adjacent an edge portion of the support surface 47 on the mattress 46 and is oriented so that the transfer surface 138 is approximately horizontal and faces upwardly at approximately the same vertical level as the support surface 47 on the mattress, the transfer surface 138 extending horizontally outwardly from the edge portion of the support surface on the mattress. The hinge leaf 147 engages the top of nut 153 in order to limit movement of the transfer board 137 about pivot pin 149 to the position shown in FIG. 7, in which transfer board 137 extends substantially horizontally. In the retracted position (FIGS. 9–10), the transfer board is oriented horizontally and is disposed within the frame 26, in particular in the recess 34 between the upper and lower frame portions 27 and 31, so that it is disposed in its entirety below the mattress and no portion thereof projects laterally outwardly beyond a side surface of the mattress.

In more detail, and with reference to FIGS. 4–5 and 13–14, when the transfer board 137 is in its operational position, the pivot member 63 and 64 are in the pivotal positions shown in FIGS. 4 and 5, in which the horizontal legs 73 and 74 of the arms 72 and 106 extend transversely of the stretcher, and the pins 79 and 112 are engaged by the stop surfaces 84 and 117. In this position of arms 72 and 106, the legs 74 and 108 thereof extend upwardly at an angle 161 (FIG. 14) of 75° with respect to a horizontal reference, and the roll pins 93 and 123 extend at a small acute angle of approximately 15° with respect to a horizontal reference. With the roll pins 93 and 123 in this position, it will be noted that the link member 91 serves to prevent pivotal movement of either pivot member 63 or 64 about the vertical axes defined by bolts 67 and 101, because both pivot axes at each clevis 92 and 121 are substantially horizontal, and there is no vertical axis at either clevis 92 or 121 which would permit the connecting plates 78 and 111 to pivot about a vertical axis relative to link member 91, which is necessary in order for plates 78 and 111 to pivot with pivot members 63 and 64 about the vertical axes defined by bolts 67 and 101. This helps to stabilize the transfer board 137 when it is in the operational position. This also serves to prevent pivotal movement of either pivot member 63 or 64 during an initial phase of movement of the transfer board away from its operational position.

More specifically, movement of the transfer board 137 from its operational position to its retracted position involves two distinct phases of movement. During the first phase the arms 72 and 106 pivot relative to the pivot members 63 and 64, and during the second phase the pivot members 63 and 64 pivot about the bolts 67 and 101 with respect to side member 32 of the frame. In each phase of movement, the link member 91 causes the arms 72 and 106 to pivot synchronously.

The first phase of movement corresponds to pivotal movement of the arms 72 and 106 from the positions in which pins 79 and 112 are engaged by stop surfaces 84 and 111 to the positions in which pins 79 and 112 are engaged by stop surfaces 83 and 116. As mentioned above, the roll pins 93 and 123 do not approach a substantially vertical position until stop surfaces 83 and 116 approach pins 79 and 112, and pivotal movement of the pivot members 63 and 64 is thus prevented until substantially the end of this first phase of movement. As a result, when a rightward force is applied to the transfer board in FIGS. 13–14 in order to initiate the first phase of movement, there is little or no tendency for the pivot members 63 and 64 to pivot, and instead the force smoothly effects only pivotal movement of the arms 72 and 106. During this first phase of movement, the universal joint 141 (FIG. 6) facilitates pivotal movement of the outer end of arm 74 relative to clevis 152 about pin 154, because the axis defined by pin 154 is parallel to the horizontal pivot axis defined by leg 73 of arm 72. Universal joint 142 facilitates similar pivotal movement for the outer end of arm 106. Further, each of the clevises 92 and 121 pivots about its horizontal axle 124 with respect to the link member 91. The transfer board 137 can remain horizontal throughout this first phase of movement, or can be in an upwardly pivoted position similar to that shown in FIG. 6 by virtue of the pivot pins 149 of the hinges.

Figure 11:
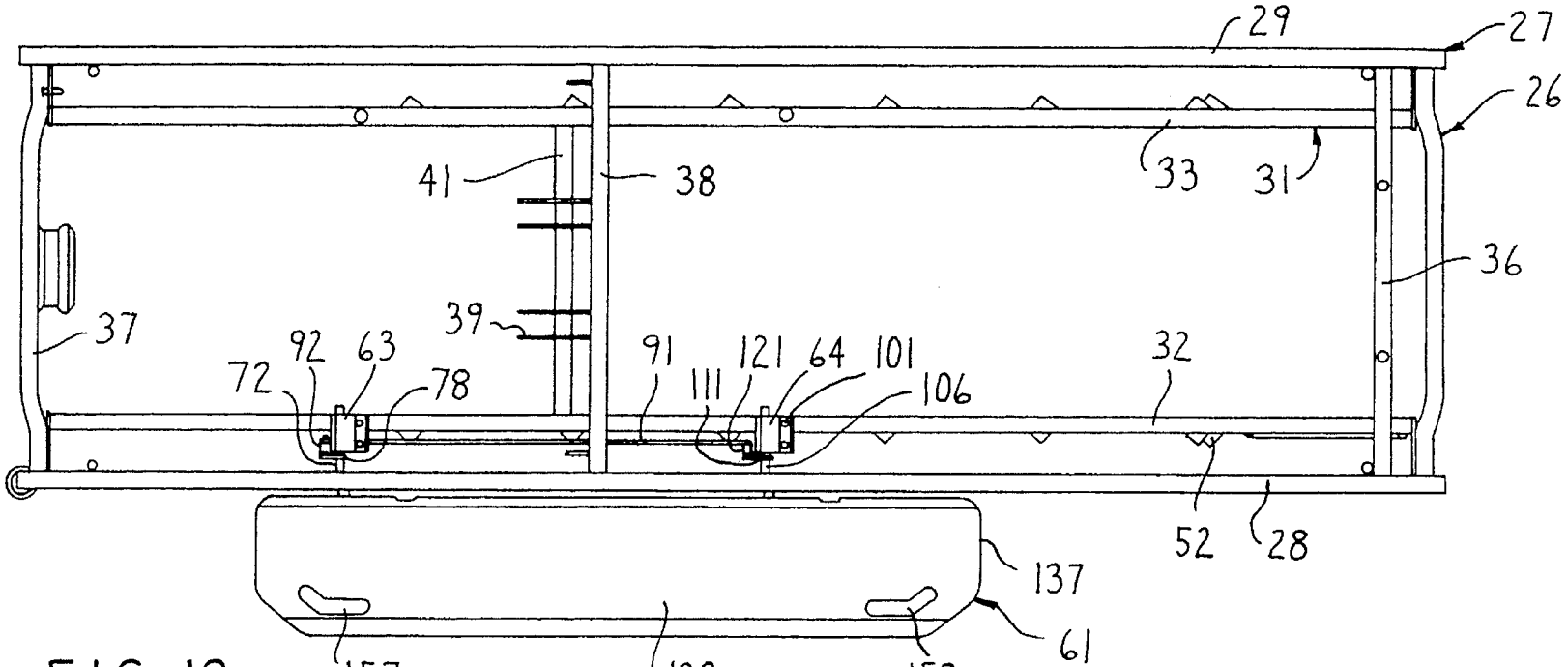
FIGS. 11 and 12 are views similar to FIGS. 9 and 10, but showing the transfer board mechanism in an intermediate position between its operational and retracted positions.

FIGS. 11–12 show an intermediate position of the transfer board mechanism 61 at the end of the first phase of movement and prior to the second phase of movement. It will be noted that the legs 74 and 108 of the arms 72 and 106 are horizontal, and thus the arms 72 and 106 each lie substantially completely within a common horizontal plane which is vertically between the side members 28 and 32 of the upper and lower frame portions 27 and 31. Further, the transfer board 137 is horizontal and is disposed vertically between the side members 28 and 32. The second phase of movement is initiated by manually urging the transfer board 137 rightwardly and inwardly in FIGS. 11 and 12.

During the second phase of movement, the pivot members 63 and 64 pivot about the vertical axes defined by bolts 67 and 101, the connecting plates 78 and 111 pivot about the vertically oriented roll pins 93 and 123 with respect to the clevises 92 and 121 and the link member 91, and the clevises 152 (FIG. 8) at the outer ends of the arms 72 and 106 pivot about the vertical axes defined by their threaded studs with respect to each hinge leaf 148. The transfer board 137 must remain horizontal during this second phase of movement. During this second phase of movement, the legs 73 and 107 of the arms 72 and 106 pivot out of a relationship parallel to the axles 124 of the clevises 92 and 121, and thus the arms 72 and 106 become unable to pivot about their legs 73 and 107 relative to the pivot members 63 and 64. Also, during this second phase of movement, the transfer board 137 and the arms 72 and 106 move inwardly into the recess 34 between the upper and lower frame portions 27 and 31.

The second phase of movement ends when the transfer board 137 reaches the retracted position shown in FIGS. 9 and 10, in which an inner edge of the transfer board engages one of the plates 39 welded on cross member 38 in a manner preventing further movement of the transfer board. With reference to FIG. 10, it should be noted that, in the retracted position, the entire transfer board mechanism 61 is disposed vertically within limits defined by the top surface of side member 28 and the bottom surface of side member 32, or in other words within the vertical height of the frame 26. Thus, the transfer board mechanism 61 is highly vertically compact in its retracted position, and has no portion projecting downwardly below the frame 26 in a manner which would interfere with vertical movement of the patient support 16 or which would interfere with medical equipment that might be temporarily interpositioned between the patient support 16 and base 12.

In order to move the transfer board 137 from its retracted position to its operational position, the two phases of movement described in detail above are carried out in a reverse order.

Figure 7:
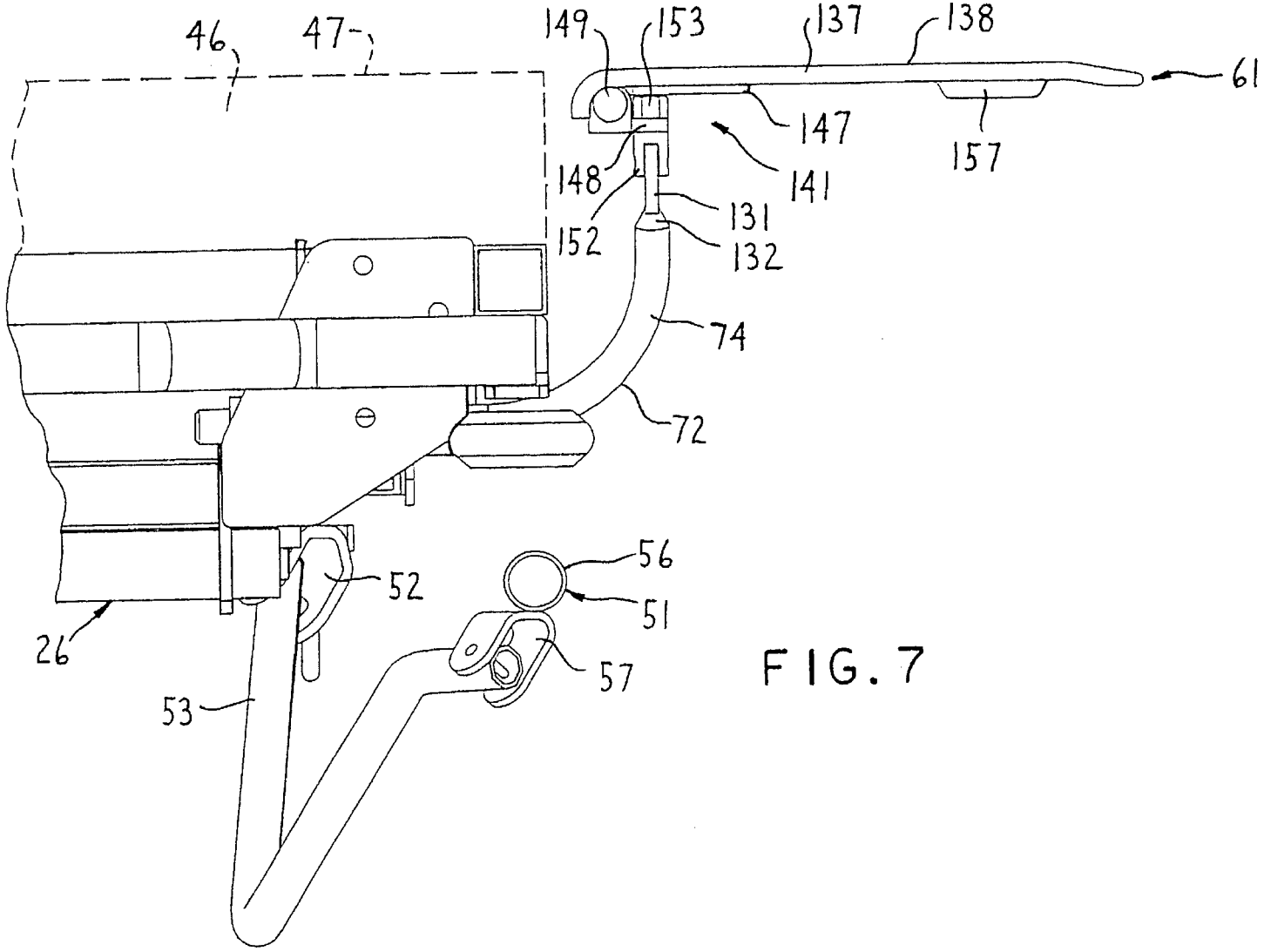
FIG. 7 is a view similar to FIG. 6, but showing the transfer board in its horizontal operational position.
Figure 14:
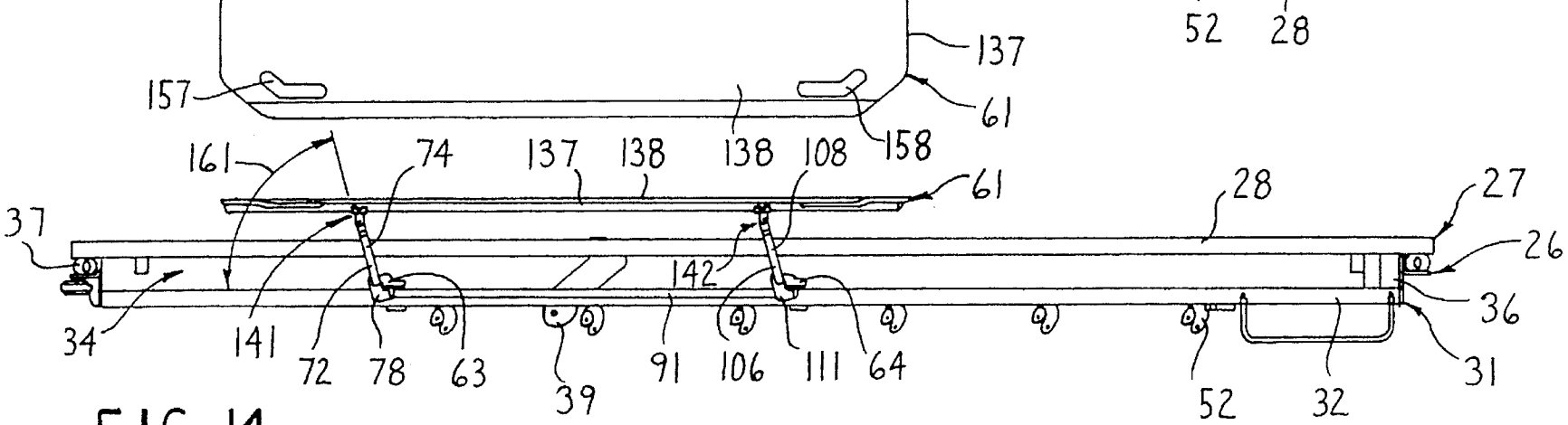

When the transfer board mechanism 61 is in the operational position of FIG. 7 it is not intended to support the entire weight of a patient being transferred. Instead, most of the underside of the transfer board 137 would rest on the top surface of a mattress of the other bed, the lift columns 21 and 22 facilitating adjustment of the vertical height of the patient support 16 and transfer board mechanism 61 in relation to the other bed. As a patient is slid across the transfer board, it can flex slightly under the patient's weight to better accommodate the shape of the patient, and to ensure that the weight is transferred through the board to the mattress of the other bed. 0n the other hand, the transfer board 137 is capable of supporting an arm of a patient during a medical procedure, or something of comparable weight. With reference to FIG. 14, it will noted that in the operational position the legs 74 and 108 of the arms, which are oriented at an angle 161 of 75° with respect to a horizontal reference, have moved 15° past an upright position, and are thus in an overcenter position in which downward forces from the weight of the board and any arm thereon tend to maintain the board in its operational position rather than urging it back toward its retracted position.

When the stretcher 10 is side-by-side with and spaced several inches from another bed or stretcher, with the transfer board mechanism 61 in its retracted position, the transfer board mechanism 61 can be easily moved to its operational position by an operator standing at the head end of the stretcher 10. Throughout its movement from the retracted to the operational position, the transfer board has a component of progressive and continuous movement toward the head end of the bed, and thus the operator pulls on the board throughout the movement and never has to push, which is an ergonomically correction motion.

When maneuvering the stretcher 10 into a position adjacent another bed for purposes of effecting a patient transfer, the transfer board 137 can be pivoted upwardly about the pivot pins 149 of the universal joints 141 and 142 to the position shown in FIG. 6, and can be pivoted back to the position of FIG. 7 when the stretcher 10 has been properly positioned with respect to the other bed. This is the primary reason for the provision of the pivot pins 149. The pivot pins 149 are not required for purposes of moving the transfer board between its operational and retracted positions.

Figure 8:
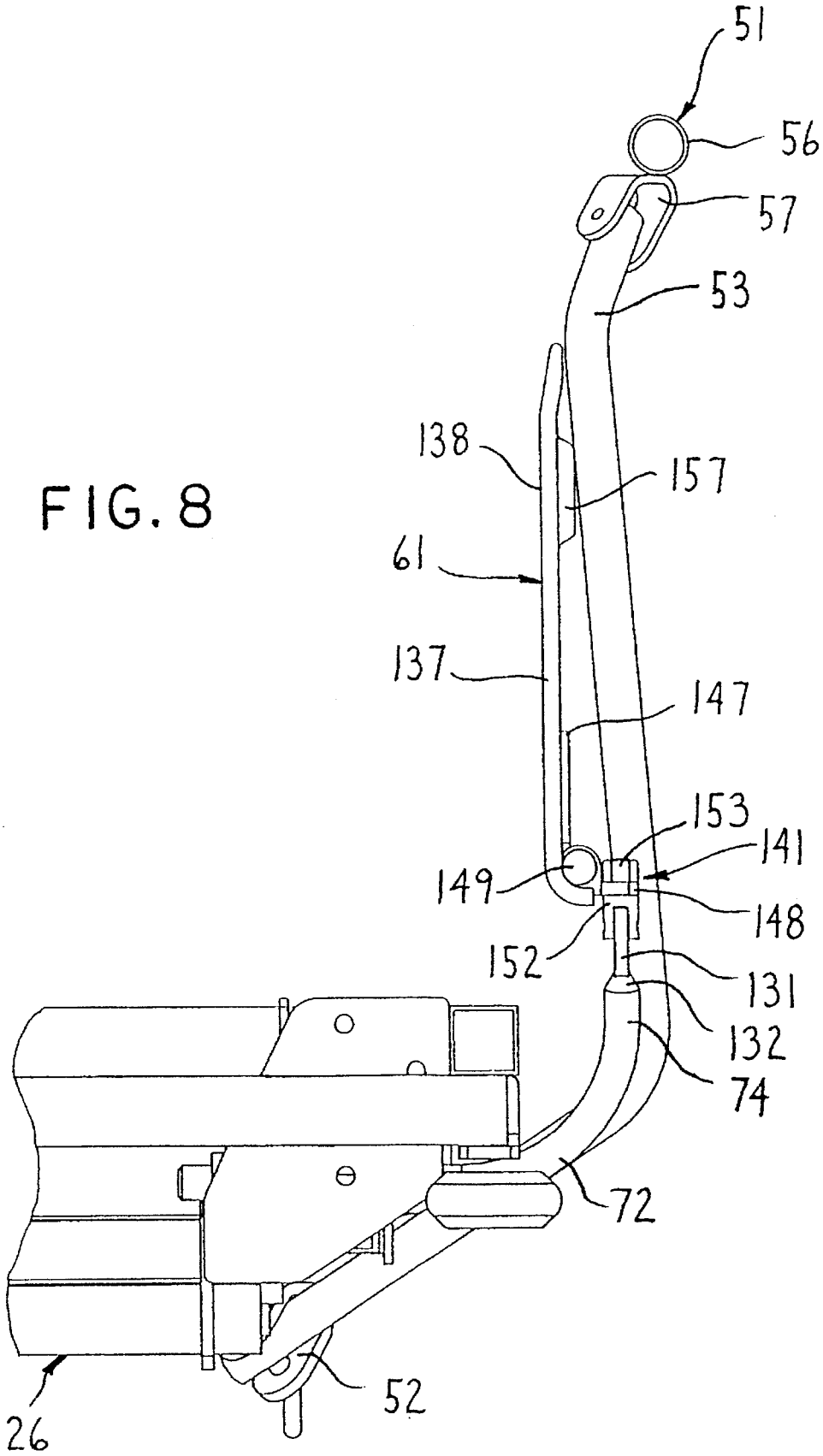
FIG. 8 is a view similar to FIG. 6 but showing the side rail in its raised position.

When the transfer board 137 is in the operational position of FIG. 7, it is possible to pivot the transfer board 137 upwardly to the position of FIG. 6 about pivot pins 149, and to then raise the side rail 51 in order to achieve the configuration shown in FIGS. 1 and 8. In this configuration, the side rail 51 engages and holds the transfer board 137 in this vertical orientation, as a result of which the transfer board 137 can supplement the function of the side rail, for example by reducing the likelihood that an arm of the patient will slip outwardly between two arms 53 of the side rail and will catch on a door frame or other external object while the stretcher 10 is being moved through a hospital.

It will be recognized that the transfer board 137 could be replaced with a different member, such as a rail which could be used to support surgical tools or to steady the arms of a surgeon during a surgical procedure. Likewise, it will be recognized that a single pivot member and arm could be provided and could have a small item fixedly supported at the outer end of the arm for movement between operational and retracted positions.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus comprising: a wheeled base, a support portion having thereon an upwardly facing support surface, lift means supporting said support portion on said base for vertical movement relative to said base, a member, and means supporting said member on said support portion for movement between a retracted position in which said member is disposed substantially entirely below said support surface and an operational position in which said member is offset horizontally and vertically from said retracted position thereof, wherein said means supporting said member includes first and second arms each having a first end movably coupled to said member and having a second end, and includes means supporting each said arm at said second end thereof on said support portion for pivotal movement about a respective substantially vertical pivot axis and for movement between first and second positions about a respective substantially horizontal pivot axis.

2. An apparatus according to claim 1, including an elongate link member having means supporting first and second pivot axles thereon for pivotal movement about horizontal pivot axes, each said pivot axle extending perpendicular to the horizontal pivot axis therefor, and first and second connecting members each fixedly secured on a respective said arm and having a portion pivotally coupled to a respective one of said pivot axles, said link member causing said arms to pivot synchronously between said first and second positions thereof, said pivot axles being parallel to each other in all operational positions of said arms and being substantially vertical when said arms are in said first positions and substantially nonvertical when said arms are in said second positions, thereby respectively permitting and preventing pivotal movement of said arms about said vertical pivot axes of said arms when said arms are respectively in said first and second positions.

3. An apparatus according to claim 1, wherein movement of said member from said operational position to said retracted position includes a first phase of movement in which said arms pivot from said second positions thereof to said first positions thereof about said horizontal pivot axis substantially free of pivotal movement about said vertical pivot axis, and a second phase of movement in which said arms each pivot about said vertical pivot axis thereof substantially free of pivotal movement about said horizontal pivot axis thereof.

4. An apparatus according to claim 3, wherein in said first position said arms each lie substantially in a horizontal plane, and wherein in said second position said first end of each said arm is offset vertically from said horizontal plane.

5. An apparatus according to claim 1, wherein said means supporting said arms includes first and second pivot members each supported on said support portion for pivotal movement about a respective said vertical pivot axis, each said arm having said second end thereof supported on a respective said pivot member for pivotal movement about said horizontal pivot axis thereof.

6. An apparatus according to claim 5, wherein each said arm has at said second end thereof a horizontal portion which is coextensive with said horizontal pivot axis thereof and is rotatably supported on a respective said pivot member.

7. An apparatus according to claim 1, wherein when said member is in said retracted position, said member and said means supporting said member have an overall vertical height which is less than a vertical height of said support portion.

8. An apparatus according to claim 1, wherein said member is a transfer member having thereon a transfer surface, and wherein in said operational position said transfer member is disposed in the region of an edge portion of said support surface on said support portion and is oriented so that said transfer surface is facing upwardly and is at approximately the same vertical level as said support surface on said support portion, said transfer surface including a portion which is disposed horizontally outwardly beyond said edge portion of said support surface in said operational position of said transfer member.

9. An apparatus according to claim 1, including means cooperable with each of said arms for effecting synchronous movement of said arms about said horizontal pivot axes substantially free of pivotal movement about said vertical axes, and facilitating synchronous movement of said arms about said vertical pivot axes substantially free of movement about said horizontal pivot axes.

10. An apparatus comprising: a wheeled base, a support portion having thereon an upwardly facing support surface, lift means supporting said support portion on said base for vertical movement relative to said base, means defining a recess which opens sidewardly into said support portion at a location below said support surface thereon, means on said support portion defining both a horizontal pivot axis and a vertical pivot axis, a member, and means supporting said member for movement about said vertical pivot axis between a retracted position in which said member is disposed substantially entirely within said recess and about said horizontal axis to an operational position in which said member is disposed outside said recess and is offset horizontally and vertically from said retracted position thereof, wherein said means supporting said member includes two arms which each have a first end movably coupled to said member and which each have a second end disposed within said recess, said means supporting said member including further means for movably supporting said second end of each said arm on said support portion and for separate movement about said horizontal and said vertical pivot axes.

11. An apparatus according to claim 10, wherein said further means supporting said second ends of said arms includes two pivot members which are each supported on said support portion for pivotal movement about a respective vertical pivot axis, and includes said second end of each said arm being supported on a respective said pivot member for pivotal movement about a respective horizontal pivot axis, said first end of each said arm being radially offset from said horizontal pivot axis thereof.

12. An apparatus according to claim 11, wherein said second end of each said arm is horizontal and substantially coextensive with said pivot axis thereof, each said arm being pivotal about said horizontal pivot axis thereof between a first position in which the entire arm lies substantially in a horizontal plane and a second position in which said first end of each said arm is offset vertically from the plane.

13. An apparatus according to claim 11, including means cooperable with each of said arms for effecting synchronous movement of said arms about said horizontal pivot axes substantially free of pivotal movement about said vertical axes, and facilitating synchronous movement of said arms about said vertical pivot axes substantially free of movement about said horizontal pivot axes.

14. An apparatus comprising: a wheeled base, a support portion having thereon an upwardly facing support surface, lift means supporting said support portion on said base for vertical movement relative to said base, means defining a recess which opens sidewardly into said support portion at a location below said support surface thereon, a transfer member having thereon a transfer surface, and means supporting said transfer member for movement between a retracted position in which said transfer member is disposed substantially entirely within said recess and an operational position in which said transfer member is disposed in the region of an edge portion of said support surface on said support portion and is oriented so that said transfer surface is facing upwardly and is at approximately the same vertical level as said support surface on said support portion, said transfer surface including a portion which is disposed horizontally outwardly beyond said edge portion of said support surface in said operational position of said transfer member.

15. An apparatus according to claim 14, wherein said means supporting said transfer member permits pivotal movement of said transfer member about a horizontal axis from said operational position in which said transfer surface is horizontal to an upright position in which said transfer surface extends approximately vertically upwardly from said edge portion of said support surface, and including a side rail supported on said support portion for movement between a retracted position disposed below said recess and a raised position in which said side rail engages and holds said transfer member in said upright position.

16. An apparatus according to claim 14, wherein said transfer surface is substantially horizontal when said transfer member is in said retracted position.

17. An apparatus comprising: a wheeled base, a support portion having thereon an upwardly facing support surface, lift means supporting said support portion on said base for vertical movement relative to said base, a member, and means supporting said member on said support portion for movement between a retracted position in which said member is disposed substantially entirely below said support surface and an operational position in which said member is offset horizontally and vertically from said retracted position thereof, wherein said means movably supporting said member includes an arm having a first end coupled to said member and having a second end, and includes means supporting said second end of said arm on said support portion for pivotal movement about a substantially vertical pivot axis and for pivotal movement about a substantially horizontal pivot axis.

18. An apparatus according to claim 17, wherein said means supporting said second end of said arm includes a pivot member supported on said support portion for pivotal movement about said vertical pivot axis, said second end of said arm being supported on said pivot member for pivotal movement about said horizontal pivot axis.

* * * * *